US005336577A

United States Patent [19]

Spiewak et al.

[11] Patent Number: 5,336,577

[45] Date of Patent: Aug. 9, 1994

[54] SINGLE LAYER PHOTORECEPTOR

[75] Inventors: John W. Spiewak, Webster; John F. Yanus, both of Webster; Damodar M. Pai, Fairport; Joseph Mammino, Penfield; Dennis A. Abramsohn, Pittsford; William W. Limburg, Penfield; Dale S. Renfer, Webster; Chei-Jen Chen, Rochester; Paul DeFeo, Sodus Point; Steven J. Grammatica, Penfield; J. Michael Ishler, Ontario; Merlin E. Scharfe; Donald S. Sypula, both of Penfield, all of N.Y.

[73] Assignee: Xerox Corporation, Stamford, Conn.

[21] Appl. No.: 71,032

[22] Filed: Jun. 2, 1993

Related U.S. Application Data

[63] Continuation of Ser. No. 814,631, Dec. 30, 1991, abandoned.

[51] Int. Cl.[5] ..... G03G 5/04

[52] U.S. Cl. ..... 430/59; 430/58

[58] Field of Search ..... 430/56, 58, 59

[56] References Cited

U.S. PATENT DOCUMENTS

| | | | |
|---|---|---|---|
| 3,764,315 | 10/1973 | Mort et al. | 430/59 |
| 4,415,640 | 11/1983 | Goto et al. | 430/59 |
| 4,474,865 | 10/1984 | Ong et al. | 430/58 |
| 4,515,882 | 7/1985 | Mammino et al. | 430/58 |
| 4,552,822 | 11/1985 | Kazmaier et al. | 430/59 |
| 4,559,287 | 12/1985 | McAneney et al. | 430/59 |
| 4,806,443 | 2/1989 | Yanus et al. | 430/56 |
| 4,818,650 | 4/1989 | Limburg et al. | 430/56 |
| 4,853,308 | 8/1989 | Ong et al. | 430/59 |
| 4,983,481 | 1/1991 | Yu | 430/59 |
| 5,030,532 | 7/1991 | Limburg et al. | 430/56 |
| 5,166,016 | 11/1992 | Badesha et al. | 430/56 |

FOREIGN PATENT DOCUMENTS 0295126 6/1964 European Pat. Off. .

OTHER PUBLICATIONS

Patent Abstracts of Japan, vol. 12, No. 323 (P-752)(3170) Sep. 2, 1988.

Patent Abstracts of Japan, vol. 11, No. 84 (P-556) Mar. 13, 1987.

Patent Abstracts of Japan, vol. 16, No. 58 (P-1311) Feb. 13, 1992.

Journal of Information Recording Materials, vol. 15, No. 4, 1987, Berlin, DDR, pp. 277-286.

Densities of Films of TMF and PVK—J. Appl. Phys. vol.43, No. 12, Dec. 1972.

*Primary Examiner*—John Goodrow

*Attorney, Agent, or Firm*—Oliff & Berridge

[57] ABSTRACT

A thick organic ambipolar layer on a photoresponsive device is simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment or dye may also be included.

28 Claims, No Drawings

SINGLE LAYER PHOTORECEPTOR

This is a continuation of Application Ser. No. 07/814,631 filed Dec. 30, 1991, now abandoned.

BACKGROUND OF THE INVENTION

This invention relates in general to a thick ambipolar layer on a photoresponsive device simultaneously capable of charge generation and charge transport.

In the art of electrophotography, an electrophotographic plate comprising a photoconductive layer on a conductive layer is imaged by first uniformly electrostatically charging the surface of the photoconductive layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As more advanced, higher speed electrophotographic copiers, duplicators and printers were developed, degradation of image quality was encountered during cycling. Moreover, complex, highly sophisticated duplicating and printing systems operating at high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles, and frequently over many thousands of consecutive cycles. There is also a great current need for long surface life, and flexible photoreceptors in compact imaging machines that employ small diameter support rollers for photoreceptor belt system compressed into a very confined space. Small diameter support rollers are also highly desirable for simple reliable copy paper stripping systems which utilize the beam strength of the copy paper to automatically remove copy paper sheets from the surface of a photoreceptor belt after toner image transfer. However, small diameter rollers, e.g., less than about 0.75 inch (19 millimeter) diameter, raise the threshold of mechanical performance criteria for photoreceptors to such a high level that spontaneous photoreceptor belt material failure becomes a frequent event for flexible belt photoreceptors. Still further, such criteria for mechanical performance may cause the crystallization or deterioration of small molecule materials within the polymer binders.

One type of single layered photoreceptor that has been employed in electrophotographic imaging systems comprises a conductive substrate and a single charge generating and transporting layer. The charge generating and transporting layer often comprises a chalcogenide material which is photoactive and unipolar. The expression "unipolar" means that the material transports a single sign of charge. In order to imagewise discharge a surface charge on the layer, frequencies of light are used which are highly absorbed in the chalcogenide material and therefore do not penetrate into the bulk of the layer. Thus, the region of the material near the surface acts as a charge generating layer and the bulk of the material acts as a charge transporting layer for one sign of charge. Yet another single layered photoreceptor that has been employed in electrophotographic imaging systems comprises a conductive substrate and a charge transfer complex consisting of poly(vinyl carbazole) and 2,4,7-tri-nitro-9-fluorenone.

One problem associated with unipolar single layer electrophotographic imaging members is that charges which are generated in the bulk of the material of a polarity opposite to that transported by the member become trapped. These trapped charges are known to cause several problems in electrophotographic applications, such as increased background in images and cyclic instabilities for machines which run several thousand cycles. Another problem with previous charge transfer complex single layer photoreceptors is their unfavorable environmental impacts and safety issues.

One type of multilayered photoreceptor that has been employed as a belt in electrophotographic imaging systems comprises a substrate, a conductive layer, a charge blocking layer, a charge generating layer and a charge transporting layer. The charge transporting layer often comprises an activating small molecule dispersed or dissolved in a polymeric film forming binder. Generally, the polymeric film forming binder in the transporting layer is electrically inactive by itself and becomes electrically active when it contains the activating molecule. The expression "electrically active" means that the material is capable of supporting the injection of photogenerated charge carriers from the material in the charge generating layer and is capable of allowing the transport of these charge carriers through the electrically active layer in order to discharge a surface charge on the active layer. The multilayered type of photoreceptor may also comprise additional layers such as an anti-curl backing layer, an adhesive layer, and an overcoating layer.

One problem associated with multilayered electrophotographic imaging members is delamination. Since the various layers of a multilayered imaging member contain different materials, the adhesion of those materials will vary. In addition, greater time and cost factors are involved in the manufacturing of a multilayered electrophotographic imaging member, as well as a greater probability of imperfections due to the multiple layers.

U.S. Pat. No. 4,983,481 to Yu, assigned to Xerox Corporation, discloses a photoreceptor in which the charge generating and charge transporting functions are clearly separated into two layers. The charge generating layer is a thin layer (less than 2 micrometers) and the charge transporting layer is a thick layer (greater than 15 micrometers). Positive carrier (hole) transport in the thin charge generating layer is carried out by selenium and a small organic molecule (namely N,N'-diphenyl-N,N'-bis(3-methylphenyl)-1,1-biphenyl-4,4-diamine. The negative carrier (electron) transport in the thin charge generating layer is also performed by the selenium. The disclosed photoreceptor is not ambipolar as only holes are transported in the thick charge transport layer.

U.S. Pat. No. 4,415,640 to Goto et al., assigned to Konishiroku Photo Industry Co., Ltd., discloses a single layered charge generating/charge transporting light sensitive device. Hydrazone compounds, such as unsubstituted fluorenone hydrazone, may be used as a carrier-transport material mixed with a carrier-generating material to make a two-phase composition light sensitive layer. The hydrazone compounds are hole transporting materials but do not transport electrons, such that the device is not ambipolar.

U.S. Pat. No. 4,552,822 to Kazmaier et al., assigned to Xerox Corporation, discloses charge generation and charge transport substances which are located in separate layers. A fluorenylidene malonitrile derivative is employed for the electron transporting substance such that the charge transport layer is an electron transporting layer, not a hole transporting layer, such that the device is not ambipolar. The (4-n-butoxycarbonyl-9-fluorenylidene)malonitrile is utilized in a layer separate from the charge generator layer such that there is no combined thick charge generating/charge transporting layer.

U.S. Pat. No. 4,559,287 to McAneney et al., assigned to Xerox Corporation, discloses a photoresponsive imaging member comprising a photogenerating layer having a photogenerating pigment optionally dispersed in an inactive resinous binder, an electron transporting layer, and a stabilizing amount of an arylamine electron donating compound. The electron transporting layer may contain a fluorenylidene derivative. The disclosed device does not have a combined charge generating/-charge transport layer and the positively charged device contains a thick charge transport layer which transports electrons, but not holes, such that the device is not ambipolar.

U.S. Pat. No. 4,474,865 to Ong et al., assigned to Xerox Corporation, discloses a photoresponsive device comprising a supporting substrate and a photogenerating layer. The photogenerating layer is in contact with an electron transporting layer comprising a fluorenylidene derivative. The photogenerating layer contains photogenerating pigments dispersed in an inactive resinous binder composition. A process of preparing (4-n-butoxycarbonyl-9-fluorenylidene) malonitrile is explained in Example 1. No combined charge generating/charge transporting layer is disclosed, and the device is capable of transporting electrons in the charge transporting layer in the positive charging mode only, and thus is not ambipolar.

Though the above-mentioned references provide for a number of alternatives for electrophotographic imaging, there continues to be a need for a single layer electrophotographic imaging member, the single layer simultaneously being capable of charge generation and charge transport, and wherein the imaging member is ambipolar and operable in either positive or negative charging modes.

SUMMARY OF THE INVENTION

It is an object of the present invention to provide a photoreceptor which overcomes problems of the prior art.

It is another object of the present invention to provide a photoreceptor with improved resistance to wear and delamination, more environmental safety, and decreased unit manufacturing cost.

It is yet another object of the present invention to provide a single layer electrophotographic imaging member, wherein the single layer is capable of charge generation and charge transport and is ambipolar.

Another object of the present invention is to provide an electrophotographic imaging member having a supporting substrate and an organic photoresponsive layer on the substrate, wherein the layer comprises a mixture of a photoresponsive pigment, an electron transport small molecule such as a fluorenylidene malonitrile, and a dihydroxy tetraphenyl benzadine containing polymer.

Still another object of the present invention is to provide an electrophotographic imaging member having a supporting substrate and an organic photoresponsive layer on the substrate, wherein the layer comprises a mixture of a fluorenylidene malonitrile and a dihydroxy tetraphenyl benzadine containing polymer, and is photoresponsive due to the charge transfer complex of these two components.

Still another object of the present invention is to provide an electrophotographic imaging member comprising a supporting substrate and a photoresponsive layer on the substrate, wherein the layer comprises a mixture of a photoresponsive pigment, a poly (ether carbonate), and a fluorenylidene malonitrile. The poly (ether carbonate), is the reaction product of N,N'-diphenyl-N,N'- bis (3-hydroxyphenyl)-(1,1' biphenyl)-4,4'diamine and diethylene glycol bis-chloroformate.

These and other objects of the present invention are achieved by providing a photoreceptor with a single organic layer that performs both charge generating and charge transport functions and is functional in either positive or negative charging modes. The photoreceptor comprises a substrate and an organic ambipolar photoresponsive layer, wherein the layer comprises an electron transport material such as a fluorenylidene malonitrile derivative, and a hole transport small molecule or polymer such as a dihydroxy tetraphenyl benzidine or a polymer containing it. Optionally the transport materials are combined in the form of a photoresponsive charge transfer complex of a condensation polymer (containing donor type units), for example a complex of a dihydroxy tetraphenyl benzidine containing polymer and a fluoroenylidene malonitrile derivative. A photoresponsive dye is optional in this embodiment. Alternatively, the transport materials may be separate and be mixed with a photoresponsive pigment or dye. Still optionally, the layer comprises a mixture of a photoresponsive pigment or dye, a poly (ether carbonate) charge transporting polymer, and a fluorenylidene malonitrile derivative. Preferably, the electron transport material is an electron transporting small molecule such as a fluorenylidene malonitrile derivative (preferably (4-n-butoxycarbonyl-9-fluorenylidene) malonitrile). The photoresponsive pigment may be selected from, e.g., pigments such as the pthalocyanines, azo pigments, trigonal Se particles, etc. A photoresponsive dye may alternatively be used. Preferred are vanadyl phthalocyanine for infrared sensitivity or Monolite Red 2Y for visible sensitivity.

In a preferred embodiment, the thick ambipolar combined generator-transport layer can be comprised of a photoresponsive charge transfer complex formed from a fluorenylidene malonitrile derivative and a dihydroxy tetraphenyl benzadine containing polymer. Still preferably the photoresponsivity of the layer can arise from the charge transfer complex of the constituent components of the tetraphenyl benzidine unit containing polymer poly (ether carbonate) and the electron acceptor 4-n-butoxycarbonyl-9-fluorenylidene malononitrile. Tetraphenyl benzidine containing polymers are described in U.S. Pat. Nos. 4,801,517, 4,806,443, 4,806,444, 4,818,650, 4,871,634, 4,935,487, 4,956,440, and 5,028,687, the entire disclosures thereof being incorporated herein by reference.

DETAILED DESCRIPTION OF PREFERRED EMBODIMENTS

The single (generator-transport) layer can be coated on any suitable metallic conductive support drum or film (Al, Ti, Ti-Zr, Ni) or on a support on which is coated a non-metallic conductive layer (carbon black in a binder, CuI alone or in a binder, poly (pyrrole) bonded to a binder, etc.). The support is generally a thermoplastic film such as polyester (Mylar, Melinex, etc.) or a thermoset drum such as a phenolic or polyester material. The support can also be a conductive non-metallic drum, such as extruded carbon black loaded polymeric binder. The coating process can be any suitable coating process such as drawbar, spin, dip, web or spray coating.

Intermediate thin layers functioning as hole and/or electron blocking and/or adhesive layers are optional. When used, such layers may include the hydrolyzed product of y-aminopropyltriethoxy silane, poly 2-hydroxyethylmethacrylate, and other related and non-related hydroxylic materials, and any other suitable hole and/or electron blocking layer compositions. The adhesive layer composition can be DuPont's 49000 polyester, Goodyear's Vitel resins (PE-100 and 200, and the like) or any other suitable adhesive composition which does not interfere with xerographic cycling.

The thick ambipolar combined generator-transport layer preferably contains a hole transporting polymeric binder, such as, poly (ether carbonate), and an electron transporting small molecule, such as, (4-n-butoxycarbonyl-9-fluorenylidene) malonitrile. Numerous other hole transporting small molecules and polymeric binders and electron transporting small molecules are also known and may be useful in this invention. Representative such materials are disclosed in U.S. Pat. No. 4,515,882, the disclosure of which is hereby totally incorporated by reference herein. The hole transporting polymeric binder and the electron transporting small molecule may form a solid state solution containing, at least in part, a charge transfer complex between the above donor and acceptor, respectively, after solvent evaporation (in the dry coating). This composition may optionally also contain a photosensitive pigment or dye, which may or may not absorb infrared radiation, but generally absorbs visible radiation. The pigment remains insoluble in the polymer-small molecule solid state solution, and functions as a charge generation site along with the charge transfer complex that forms between the poly(ether carbonate) and (4-n-butoxycarbonyl-9-fluorenylidene)malonitrile.

The parameters of an exemplary photoreceptor of an embodiment of the invention are as follows:

| | Satisfactory | Preferred | Optimum |
|---|---|---|---|
| Single Layer Thickness (micrometers) | 1–50 | 5–40 | 10–25 |
| poly(ether carbonate)/(4-n-butoxycarbonyl-9-fluorenylidene)malonitrile (Molar Ratio)[a] | 0.1–10.0 | 0.3–5.0 | 0.3–3.0 |
| vanadyl phthalocyanine Loading (vanadyl phthalocyanine/poly-(ether carbonate) Weight Ratio) | .001–2.0 | .005–1.5 | .01–1.0 |

[a]Molar ratio of poly(ether carbonate) repeat units to moles of (4-n-butoxycarbonyl-9-fluorenylidene)mononitrile.

1. Adhesion and Cost

A significant advantage of the single layer photoreceptor is the cost savings realized (lower unit manufacturing cost) in fabricating only one layer, as opposed to several layers in presently used organic photoreceptors. Also, photoreceptor yields are higher in one layer devices since yields decrease, due to imperfections, with each successive coating step. In the present invention, a combined generator-transport layer can be applied directly onto a substrate such as a titanized Mylar conductive substrate, without using a hole blocking and/or adhesive layer, thus increasing the fabrication simplicity, and decreasing manufacturing costs. Optionally, the single generator-transport layer can be coated onto a thin hole blocking layer (AL) and an adhesive layer (AL), but these thin layers are not needed to obtain an electrically functional photoreceptor for most environments.

Regardless of whether blocking and adhesive layers are utilized, no evidence of delamination during cutting and tape mounting and dismounting of the sheet device (onto the drum used for electrical testing) was witnessed. In general, photoreceptors that show no tendency towards delamination when manually manipulated for electrical testing, have sufficient adhesion to function without adhesion failure. The good adhesion is because of the single layer structure. Also, poly(ether carbonate) functionalities promote good surface wetting and adhesion at most interfaces.

2. Ambipolar Charging and Disposability

Although the photoreceptor of this invention is more sensitive when charged positively, the device is functional whether positively or negatively charged (is ambipolar), particularly in lower volume copiers/printers. The positively charged device can also be used with faster mid and high volume xerographic machines. The two main advantages of positive charging are: a) less ozone and oxides of nitrogen are generated from the corona, and therefore lifetimes for other xerographic components are increased (especially rubber materials in the corotron discharge area), and b) more uniform charge density on the photoreceptor surface is achieved, enabling more uniform xerographic images (especially in solid areas).

When employing non-mutagenic poly(ether carbonate) and (4-n-butoxycarbonyl-9-fluorenylidene)mononitrile as electron donor and acceptor molecules respectively, and when employing the nonmutagenic vanadyl phthalocyanine as pigment, the resulting organic photoreceptor is disposable (no known hazards at this time) and therefore is particularly useful in low volume machines which employ cartridges.

A photoreceptor utilizing a polymeric material, poly(N-vinylcarbazole), and a small molecule 2,4,7-trinitro-9-fluorenone, is comprised of a charge transfer complex of poly(N-vinylcarbazole) and 2,4,7-trinitro-9-fluorenone along with some of the uncomplexed components, wherein charge carriers are photogenerated in the absorption region of the charge transfer complex. The charge transfer complex and the uncomplexed 2,4,7-trinitro-9-fluorenone transport electrons, and the uncomplexed poly(N-vinylcarbazole) transfers holes. Although this bulk conductive photoreceptor (~15 micrometer thick) was used commercially, it was eventually removed from the marketplace after it was determined that 2,4,7-trinitro-9-fluorenone was mutagenic (failed the Ames Test). A description of the charge generator and transport events of this single layered device is presented in a paper by W. D. Gill, "Drift Mobilities in Amorphous Charge Transfer Complexes of Trinitrofluorenone and Poly(N-Vinylcarbazole)" in J. Appl. Phys. 43, 5033–5040 (1972). The present invention is non-mutagenic.

3. The Single Ambipolar Charge Generation and Transport Layer

Preferred single layered devices of the present invention are non-mutagenic (pass the Ames Test). The present invention may utilize an infrared sensitive pigment vanadyl phthalocyanine as the primary photogeneration source because it is unlikely that significant charge photogeneration occurs in the charge transfer complex at 780 nm. Thus, another advantage of the present invention versus the previously-mentioned mutagenic device, is infrared charge photogeneration, which enables the use of gallium-arsenide and gallium-aluminum-arsenide laser diodes and more compact printer stations. Poly(ether carbonate), on the average, transports holes about 2 orders of magnitude faster than poly(ether carbonate) (drift mobility of PEC$\sim 10^{-4}$ and that of poly(ether carbonate) $10^{-6}$ $cm^2$/volt-sec). The (4-n-butoxycarbonyl-9-fluorenylidene) malonitrile (4-n-butoxycarbonyl-9-fluorenylidene)mononitrile and poly(ether carbonate) charge transfer complex poly(ether carbonate)-(4-n-butoxycarbonyl-9-fluorenylidene)-mononitrile transports electrons. The poly(ether carbonate)-(4-n-butoxycarbonyl-9-fluorenylidene)mononitrile charge transport complex may also transport holes.

An additional advantage of embodiments of the present invention is the increased solubility of (4-n-butoxycarbonyl-9-fluorenylidene)mononitrile in most organic solvents (versus, e.g., 2,4,7-trinitro-9-fluorenone. The enhanced (4-n-butoxycarbonyl-9-fluorenylidene)-mononitrile solubility makes formulating and coating the poly(ether carbonate)-(4-n-butoxycarbonyl-9-fluorenylidene)mononitrile pigment compositions easier (more solvent options for good dispersions). In addition to the above-mentioned (4-n-butoxycarbonyl-9-fluorenylidene)mononitrile other fluorenylidene malonitrile derivatives such as the hexyl and octyl esters, (4-p-n-butylphenylcarbonyl-9-fluorenylidene) malonitrile, and (4-p-n-pentyl-4-biphenylcarbonyl-9-fluorenylidene) malonitrile may also be used as suitable electron transport materials. Other fluorenylidene malonitrile derivatives useful in the invention include those described in U.S. Pat. No. 4,474,865, the disclosure of which is totally incorporated herein by reference.

Instead of or in addition to vanadyl phthalocyanine, other suitable pigments (infrared or non-infrared active) may be incorporated into the dispersion for the purpose of generating positive and negative carriers when exposed to radiation to which the pigment is sensitive. The pigments may be used individually or combined with other pigments to generate a broader wavelength absorption range which may or may not be fully utilized depending on the wavelength range of the incident radiation. Some suitable pigments include t-Selenium, vanadyl phthalocyanine, metal free phthalocyanine, chloroindium phthalocyanine, benzimidazole perylene, dibromoanthanthrone, 2,7bis(2-hydroxy-3-(N-2-chlorophenylcarboxamido)-1-naphthylazo)-9-fluorenone, 2,7bis[2-hydroxy-3-(5-chloro-2-benzimidazoyl)-1-naphthylazo]-3,6-dichloro-9-fluorenone, and tris azo pigments. Symmetrical and unsymmetrical squaraines described in U.S. Pat. Nos. 4,508,803 and 4,886,722 suitable for this invention include bis (2-fluoro-4-methylbenzylaminophenyl) squaraine, bis (2-fluoro-4-methyl-p-chlorobenzylaminophenyl) squaraine, bis (2-fluoro-4-methyl-p-fluorobenzylaminophenyl) squaraine, bis (2-fluoro-4-methyl-m-chlorobenzylaminophenyl) squaraine, 4-dimethylaminophenyl-4-methoxyphenyl squaraine, and 2-hydroxy-4-dimethylaminophenyl-4-methoxyphenyl squaraine, and 2-fluoro-4-dimethylaminophenyl-3,4-dimethoxyphenyl squaraine.

Other dihydroxy tetraphenyl benziadine containing polymers, electrically similar to poly(ether carbonate), could be used in place of poly(ether carbonate) in this invention. In U.S. Pat. No. 4,818,650 (the disclosure of which is totally herein incorporated by reference), two dihydroxy tetraphenyl benzidine containing polymers are described that are sufficiently oxidatively stable to function effectively as electrical substitutes for poly(ether carbonate). A para dihydroxy tetraphenyl benzidine polymer also containing methyl ether groups (internally and as end groups), backbone ether groups, and the tetraphenyl benzidine triarylamine groups are also usable in place of poly(ether carbonate), as well as meta-dihydroxy tetraphenyl benzidine polymer also containing secondary hydroxyl groups, backbone ether groups and the triarylamine groups present in tetraphenyl benzidine containing polymers. The structures of such tetraphenyl benzidine containing polymers are as follows:

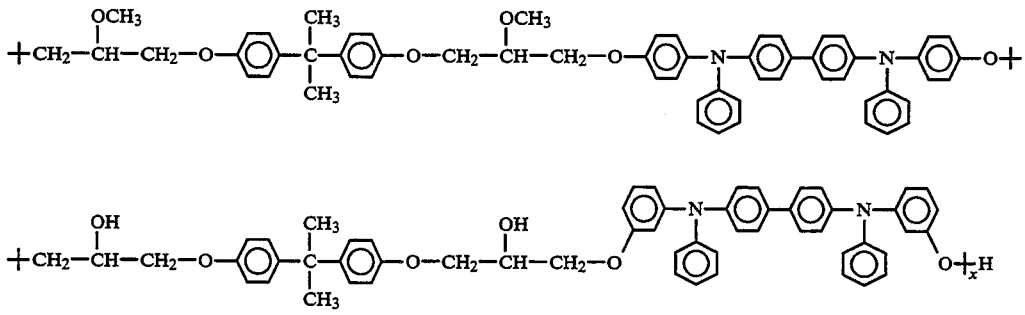

-continued

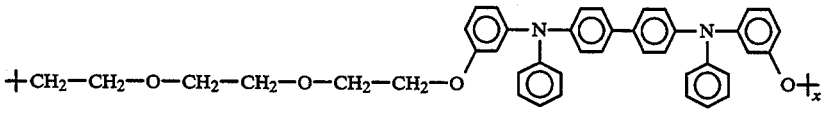

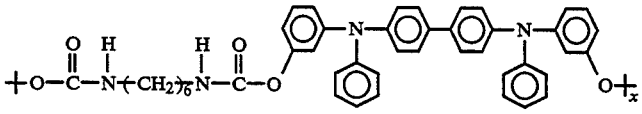

As discussed above, other known hole transporting polymers may also be used.

4. The Optional Blocking Layer

An optional blocking layer may be used in the present invention. Electron blocking layers for positively charged photoreceptors allow holes from the imaging surface of the photoreceptor to migrate toward the conductive layer. For negatively-charged photoreceptors, any suitable hole blocking layer capable of forming a barrier to prevent hole injection may be utilized. The hole blocking layer may include polymers such as polyvinylbutyral, epoxy resins, polyesters, polysiloxanes, polyamides, polyurethanes and the like, or may be nitrogen-containing siloxanes or nitrogen-containing titanium compounds such as trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)-titanate, titanium-4-amino benzene sulfonate oxyacetate, titanium 4-aminobenzoate isostearate oxyacetate, $[H_2N(CH_2)_4]CH_3Si(OCH_3)_2$ (delta-aminobutyl methyl dimethoxy silane), $[H_2N(CH_2)_3]CH_3Si(OCH_3)_2$ (gamma-aminopropyl) methyl dimethoxy silane), and $[H_2N(CH_2)_3]Si(OCH_3)_3$ (gamma-aminopropyl trimethoxy silane) as disclosed in U.S. Pat. Nos. 4,338,387, 4,286,033 and 4,291,110 (the disclosures of which are herein totally incorporated by reference). The hole blocking layer may also include delta-aminobutyl methyl diethoxy silane, gamma-aminopropyl methyl diethoxy silane, and gamma-aminopropyl triethoxy silane.

The blocking layer should be continuous and have a thickness of less than about 0.5 micrometer because greater thicknesses may lead to undesirably high residual voltage. A blocking layer of between about 0.005 micrometer and about 0.3 micrometer is satisfactory because charge neutralization after the exposure step is facilitated and good electrical performance is achieved. A thickness between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by air convection and vacuum heating and the like.

5. The Optional Adhesive Layer

Intermediate layers between the blocking layer and the charge generating/charge transporting single layer may be desired to promote adhesion. If such layers are utilized, they preferably have a dry thickness between about 0.01 micrometer to about 0.3 micrometer, more preferably about 0.05 to about 0.2 micrometer. Typical adhesive layers include film-forming polymers such as polyester, duPont 49,000 resin (available from E. I. duPont de Nemours & Co.), Vitel PE-100 (available from Goodyear Rubber & Tire Co.), polyvinylbutyral, polyvinylpyrrolidone, polyurethane, polymethyl methacrylate, and the like. Both the duPont 49,000 and Vitel PE-100 adhesive layers are preferred because they provide reasonable adhesion strength and produce no deleterious electrophotographic impact on the resulting imaging members.

EXAMPLE 1

An ambipolar single layer (charge generating/transporting layer) photoreceptor was formulated, coated, and electrically tested as follows:

(1) The poly(ether carbonate) 1.0 gram (0.00147 mole) and a hole transporting polymer prepared as described in Example III of U.S. Pat. No. 4,806,443 (the subject matter therein is hereby totally incorporated herein by reference) was dissolved in 8 milliliters of dichloromethane (in a 1 ounce amber bottle with a polyseal cap) with agitation provided by a wrist shaker for about 1 hour.

(2) To this solution were added two pigments: 0.03 gram of an infrared sensitive pigment, vanadyl phthalocyanine, and 0.03 gram of trigonal selenium and 50 grams of #302 stainless steel shot. The mixture was paint shaken for 20 minutes to create a pigment dispersion.

(3) To this dispersion was added 0.35 gram (0.00107 mole) of (4-n-butoxycarbonyl-9-fluorenylidene) malonitrile, an electron transporting molecule, and the dispersion was wrist shaken for 10 minutes to dissolve the electron transport molecule.

(4) The above dispersion was drawbar coated (4 mil bar gap) onto a titanized Mylar conductive substrate and after brief (2.0 min.) ambient drying, the device was transferred to a forced air oven at 35° C. and the temperature was slowly increased to 100° C. in 25 minutes. The device was removed from the oven, and the oven temperature was increased to 120° C. at which time the device was loaded into the oven and was dried at 120° C. for 5 minutes. The resulting single layer ambipolar device (Device 1-1 in Table 1.1) was 18 micrometers thick as measured with a DS No. 11033 permascope.

This device was electrically tested with a cyclic scanner set to obtain 100 charge-erase cycles immediately followed by an additional 100 cycles, sequenced as two charge-erase cycles and one charge-expose-erase cycle, wherein the light intensity was incrementally increased with cycling to produce a photoinduced discharge curve from which the photosensitivity was measured. The scanner was equipped with a single wire corotron (5 cm wide) set to deposit $14\times10^{-8}$ coulombs/cm$^2$ of charge on the surface of the experimental devices. The devices were first tested in the negative charging mode and then immediately thereafter in the positive charging mode. The exposure light intensity was incrementally increased by means of regulating a series of neutral density filters, and the exposure wavelength was controlled by a bandfilter at 780+ or −5 nanometers. The exposure light source was a 1000 watt Xenon Arc Lamp run at 38 amperes. The erase lamp, used to discharge the devices completely, consisted of a 150 watt Xenon Arc Lamp white light source emitted through a fiber optic light pipe.

The devices were tape mounted to an aluminum drum having a 63.1 cm circumference and the drum was rotated at a speed of 20 rpm to produce a surface speed of 8.3 inches per second or a cycle time of 3 seconds. The entire xerographic simulation was carried out in a environmentally controlled light tight chamber at ambient conditions (35% RH and 20° C.).

In the negative charging mode for the first 100 cycles, device 1-1 (in Table 1.1) cycled flat at about 700 volts (38.9 volts per micrometer), and the residual voltage remained constant at about 10 volts, as did the dark decay at about 97 volts/sec. In the second consecutive 100 cycles, the above variables remained essentially constant and the photosensitivity of the device was estimated by extrapolating the initial slope of the photodischarge curve (voltage versus ergs/cm$^2$) to the abscissa to give a value of 39–40 ergs/cm$^2$. Without significantly resting the device (~10 minute time delay), the polarity of the corotron was reversed and the same electrical testing sequence was performed in the positive charging mode. For the first 100 cycles, this device cycled flat at about 595 volts (33.0 volts per micrometer) and the residual voltage remained constant at about 10 volts, as did the dark decay at about 126 volts/sec. In the second 100 consecutive cycles, the above variables remained essentially constant and the photosensitivity of the device, again estimated by extrapolation of the initial slope of the photodischarge curve to the abscissa, was about 7–8 ergs/cm$^2$.

The stoichiometric ratio of the hole transport unit in the poly (ether carbonate) versus the electron transport small molecule, (4-n-butoxycarbonyl-9-fluorenylidene) malonitrile, was obtained after structurally defining the hole transport and electron transport units as shown below.

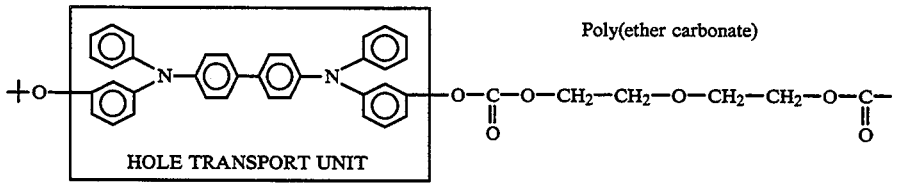

$$\frac{\text{HOLE TRANSPORT UNIT MW} = 486.62}{\text{TOTAL REPEAT UNIT MW} = 678.75} \times 100 = 71.7\%$$

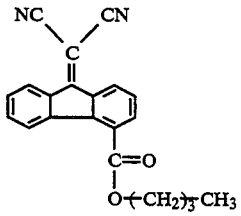

ELECTRON TRANSPORT MOLECULE (4-n-butoxycarbonyl-9-fluorenylidene) malonitrile Thus the stoichiometry utilized in example I favors the hole transport species in a molar excess of about 1.39 to 1.0 versus the malonitrile electron transport molecule.

A second device (Device 1-2 in Table 1.1) was formulated as above except 0.02 gram of vanadyl phthalocyanine was used and the trigonal selenium was omitted. In this second device of example I, only long wavelength exposure (780 nm) was a feasible option since standard 550 nm exposure (for Se) would not significantly discharge the device. The hole transport to electron transport stoichiometric ratio remained as above. Device coating and drying conditions and the cyclic electrical testing conditions and protocol remained unchanged. A 19 micrometer thick device (1-2) was obtained which displayed no significant changes in the first and second consecutive 100 cycle electrical tests in each charging mode. The cyclic electrical results for devices 1-1 and 1-2 are summarized below in Table 1.1.

TABLE 1.1

| | Cyclic Electrical Results | | | |
|---|---|---|---|---|
| Test Variable | Negative Charge | | Positive Charge | |
| Device No. | 1-1 | 1-2 | 1-1 | 1-2 |
| Charging (volts/μm) | 38.9 | 37.9 | 33.0 | 31.6 |
| Residual Voltage (volts) | 10 | 10 | 10 | 10 |
| Dark Decay (volts/sec) | 97 | 81 | 126 | 118 |
| Sensitivity (ergs/cm$^2$) | 39–40 | 30–31 | 7–8 | 9–10 |

The above negatively charged devices are characterized by a higher charging level, lower dark decay and lower photosensitivity. The smaller the sensitivity value, the higher is the actual sensitivity of the device. The positively charged devices were charged to a lower level and dark decayed slightly more than the same devices when charged negatively. However, the sensitivity in the positive charging mode was about four times that of the negatively charged devices.

Example II

The objective of this experiment was to observe the changes in cyclic electrical properties incurred by increasing the loading of the infrared sensitive pigment, vanadyl phthalocyanine, in the single (generator-transport) layered device. The dispersion formulation scale was 2 times that used in Example I.

(1) The poly (ether carbonate), 2.03 grams (0.003 mole), and (4-n-butoxycarbonyl-9-fluorenylidene) malonitrile, 0.66 gram (0.002 mole), were dissolved in 16 milliliters of dichloromethane (in a 2 ounce amber bottle with a polyseal cap) with the help of wrist shaker agitation in about 1 hour.

(2) To each of four solutions was added increasing amounts of vanadyl phthalocyanine and 100 grams of #302 stainless steel shot. These mixtures were then paint shaken for about 1 hour to create a pigment dispersion. Devices 2-1, 2-2, 2-3, and 2-4 (in Tables 2.1 and 2.2) contained 0.04, 0.06, 0.08, and 0.10 gram vanadyl phthalocyanne respectively.

(3) Dispersions 2-1 to 2-3 (3 mil bar gap) dispersion 2-4 (5 mil bar gap) were drawbar coated onto a trilayer partial device consisting of a titanized Mylar conductive substrate on top of which was coated a thin hole blocking layer (the hydrolyzed product of γ-aminopropyltriethoxy silane), and a thin adhesive polyester (PE-49000 from duPont). Each of these thin layers was <0.05 micrometer in thickness. After coating the thick generator-transport layer over the thin layers, the devices were dried at ambient conditions (about 0.5 hour) to flash off the solvent bulk. The devices were finally dried in a forced air oven while increasing the temperature from ambient to 125° C. in 0.5 hour and then dried an additional 10 minutes at 125° C. The resulting single generator-transport layer ambipolar devices had thicknesses of 15, 23, 24 and 25 micrometers respectively for devices 2-1 through 2-4 as measured with a DS No. 11033 permascope.

(4) The devices were electrically cycled as described in example I, and the results are summarized in Tables 2-1 and 2-2 for negative and positive charging respectively.

TABLE 2.1

| Test Variable | Negative Charging Electricals | | | |
|---|---|---|---|---|
| Device No. | 2-1 | 2-2 | 2-3 | 2-4 |
| Charging (volts/μm) | 36.3 | 30.4 | 29.8 | 31.4 |
| Residual Voltage (volts) | 10 | 10 | 10 | 15 |
| Dark Decay (volts/sec) | 43 | 102 | 113 | 151 |
| Sensitivity (ergs/cm$^2$) | 23–24 | 27–28 | 25–26 | 34–35 |

TABLE 2.2

| Test Variable | Positive Charging Electricals | | | |
|---|---|---|---|---|
| Device No. | 2-1 | 2-2 | 2-3 | 2-4 |
| Charging (volts/μm) | 32.3 | 26.3 | 26.3 | 28.8 |
| Residual Voltage (volts) | 10 | 10 | 10 | 12 |
| Dark Decay (volts/sec) | 59 | 113 | 124 | 161 |
| Sensitivity (ergs/cm$^2$) | 11–12 | 9–10 | 5–6 | 7–8 |

The above electrical trends are the same as those found in example I for the different charging modes. However as the vanadyl phthalocyanine pigment level increases in the devices of example II, the dark decay also increases significantly indicating the pigment in some way is accountable for the increased dark decay since the other variables are constant. The stoichiometric ratio of hole transport species in the poly (ether carbonate) to the malonitrile electron transport species has been increased further to 1.5 to 1.0 in example II versus 1.39 to 1.0 in example I.

EXAMPLE III

An ambipolar single layer (charge generating/transporting layer) photoreceptor was formulated, coated, and electrically tested as follows:

(1) About 1 gm ($1.5\times10^{-3}$ moles) of poly(ether carbonate) polymer is dissolved in 10 milliliters of methylene chloride. About 0.5 gm ($1.5\times10^{-3}$ moles) of (4-n-butoxycarbonyl-9-fluorenylidene) malonitrile, BCFM, is thoroughly mixed with the PEC polymer mixture.

(2) A draw bar coating on a substrate of titanized Melinex with γ-aminopropyltriethoxy silane, blocking layer and 49k adhesive layer is made in the usual manner utilizing a 5 mil draw bar.

(3) The coating was dried at 100° C. for 30 minutes in a forced air oven.

(4) The sample was tested in an electrical characterization scanner and was found to charge very well to both positive and negative polarities and had good xerographic sensitivities for both polarities of charging.

EXAMPLE IV

An ambipolar single layer (charge generating/transporting layer) photoreceptor was formulated according to the procedure in example III except the composition was 1:1 weight ratio of poly(ether carbonate)-(4-n-butoxycarbonyl-9-fluorenylidene)mononitrile (about $1.5\times10^{-3}$ mole: about $3.0\times10^{-3}$ mole). After forming a draw bar coating according to the procedure in example III, the sample was tested in a scanner and was found to charge very well to both positive and negative polarities and had good xerographic sensitivities for both polarities of charging.

While the invention has been described with reference to particular preferred embodiments, the invention is not limited to the specific examples given, and other embodiments and modifications can be made by those skilled in the art without departing from the spirit and scope of the invention and the claims.

What is claimed is:

1. An ambipolar photoresponsive device comprising:

a supporting substrate;

a single organic layer on said substrate for both charge generation and charge transport, for forming a latent image from a positive or negative charge source, such that said layer transports either electrons or holes to form said latent image depending upon the charge of said charge source, said layer comprising a photoresponsive pigment or dye, a hole transporting small molecule or polymer and an electron transporting material, said electron transporting material comprising a fluorenylidene malonitrile derivative; and said hole transporting polymer comprising a dihydroxy tetraphenyl benzidine containing polymer.

2. The photoresponsive device of claim 1 wherein the fluorenylidene malonitrile derivative is selected from the group consisting of (4-n-butoxycarbonyl-9-fluorenylidene) malonitrile, (4-p-n-butylphenylcarbonyl-9-fluorenylidene) malonitrile, (4-p-n-pentyl-4-biphenylcarbonyl-9-fluorenylidene) malonitrile, hexyl esters of fluorenylidene malonitrile, and octyl esters of fluorenylidene malonitrile.

3. The photoresponsive device of claim 1 wherein the dihydroxy tetraphenyl benzidine containing polymer is selected from the group consisting of

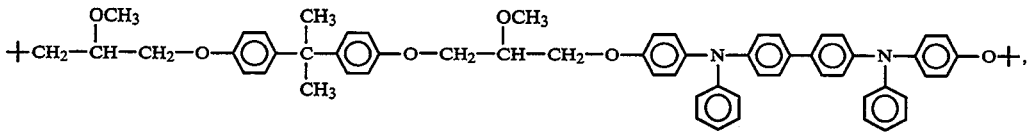

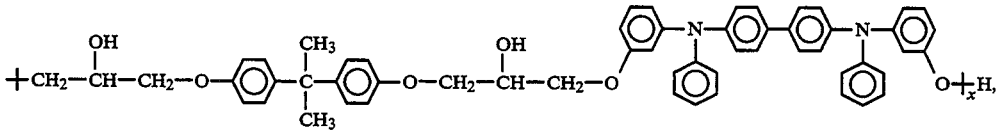

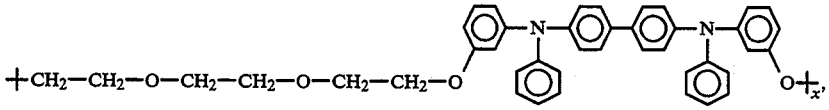

and

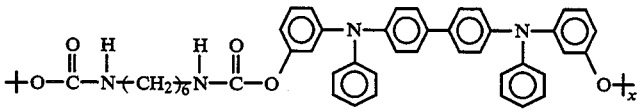

4. The photoresponsive device of claim 1, wherein the polymer is selected from the group consisting of

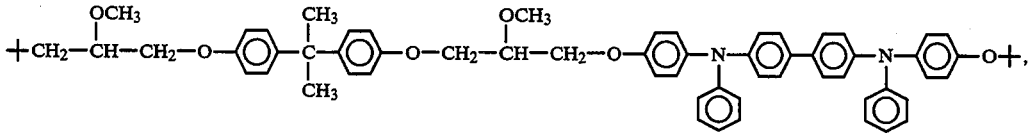

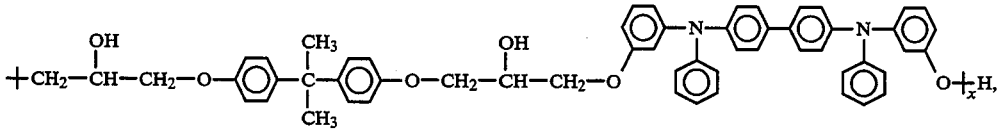

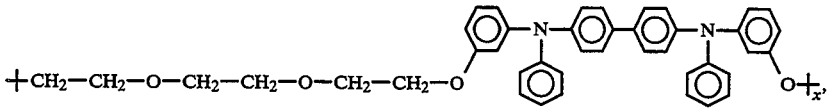

and

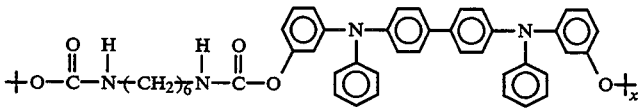

said hole transporting polymer and said electron transporting material together constitute a photoresponsive complex.

5. The photoresponsive device of claim 1, wherein said photoresponsive pigment is selected from the group consisting of t-selenium, a phthalocyanine derivative, a squaraine derivative, a fluorenone derivative, and an azo derivative.

6. The photoresponsive device of claim 4, wherein the electron transporting material is selected from the group consisting of (4-n-butoxycarbonyl-9-fluorenylidene) malonitrile, (4-p-n-butylphenylcarbonyl-9-fluorenylidene) malonitrile, (4-p-n-pentyl-4-biphenylcarbonyl-9-fluorenylidene) malonitrile, hexyl esters of fluorenylidene malonitrile, and octyl esters of fluorenylidene malonitrile.

7. The photoresponsive device of claim 4, wherein

8. The photoresponsive device of claim 1, further comprising a hole blocking layer.

9. The photoresponsive device of claim 8, wherein said hole blocking layer comprises a hole blocking material selected from the group consisting of polyvinyl butyral, epoxy resins, polyesters, polysiloxanes, polyamides, polyurethanes, nitrogen containing siloxanes, and nitrogen containing titanium compounds.

10. The photoresponsive device of claim 8, wherein said hole blocking layer comprises poly 2-hydroxy ethyl methacrylate or hydrolyzed $\gamma$-amino propyl triethoxy silane.

11. The photoresponsive device of claim 1, further comprising an adhesive layer.

12. The photoresponsive device of claim 11, wherein said adhesive layer comprises an adhesive material selected from the group consisting of polyesters, polyvinylbutyrals, polyvinylpyrrolidones, polyurethanes and polymethyl methacrylates.

13. The photoresponsive device of claim 1, wherein said layer is from 1–50 micrometers thick.

14. The photoresponsive device of claim 1, wherein said layer is from 5–40 micrometers thick.

15. The photoresponsive device of claim 1, wherein said layer is from 10–25 micrometers thick.

16. The photoresponsive device of claim 4, wherein said layer is from 1–50 micrometers thick.

17. The photoresponsive device of claim 4, wherein said layer is from 5–40 micrometers thick.

18. The photoresponsive device of claim 4, wherein said layer is from 10–25 micrometers thick.

19. An ambipolar photoresponsive device comprising:

a supporting substrate;

a single organic layer on said substrate for both charge generation and charge transport, for forming a latent image from a positive or negative charge source, such that said layer transports either electrons or holes to form said latent image depending upon the charge of said charge source, said layer comprising a photoresponsive pigment or dye, a hole transporting small molecule or polymer and an electron transporting material, said photoresponsive pigment is vanadyl phthalocyanine, said electron transporting material is (4-n-butoxycarbonyl-9-fluorenylidene) malonitrile, and said hole transporting polymer is poly(ether carbonate).

20. The photoresponsive device of claim 19, wherein a molar ratio of said poly (ether carbonate) to said (4-n-butoxycarbonyl-9-fluorenylidene) malonitrile is from about 0.1 to about 10.

21. The photoresponsive device of claim 19, wherein a molar ratio of said poly (ether carbonate) to said (4-n-butoxycarbonyl-9-fluorenylidene) malonitrile is from about 0.3 to about 5.

22. The photoresponsive device of claim 19, wherein a molar ratio of said poly (ether carbonate) to said (4-n-butoxycarbonyl-9-fluorenylidene) malonitrile is from about 0.3 to about 3.

23. The photoresponsive device of claim 19, wherein a weight ratio of said vanadyl phthalocyanine to said poly (ether carbonate) is from about 0.001 to about 2.

24. The photoresponsive device of claim 19, wherein a weight ratio of said vanadyl phthalocyanine to said poly (ether carbonate) is from about 0.005 to about 1.5.

25. The photoresponsive device of claim 19, wherein a weight ratio of said vanadyl phthalocyanine to said poly (ether carbonate) is from about 0.01 to about 1.

26. An ambipolar photoresponsive device comprising:

a supporting substrate;

a single layer on said substrate for both charge generation and charge transport, for forming a latent image from a positive or negative charge source, such that said layer transports either electrons or holes to form said latent image depending upon the charge of said charge source, said layer comprising a dihydroxy tetraphenyl benzidine containing polymer complexed with an electron transporting material.

27. The photoresponsive device of claim 26, wherein the electron transporting material is selected from the group consisting of (4-n-butoxycarbonyl-9-fluorenylidene) malonitrile, (4-p-n-butylphenylcarbonyl-9-fluorenylidene) malonitrile, (4-p-n-pentyl-4-biphenylcarbonyl-9-fluorenylidene) malonitrile, hexyl esters of fluorenylidene malonitrile, and octyl esters of fluorenylidene malonitrile.

28. The photoresponsive device of claim 26, wherein the polymer is selected from the group consisting of

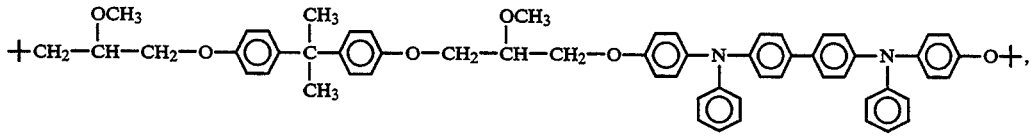

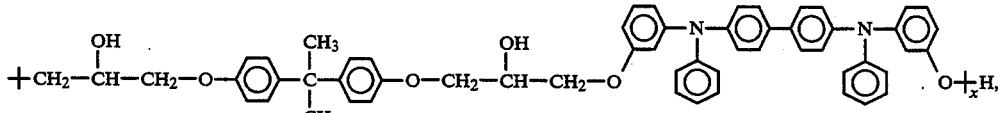

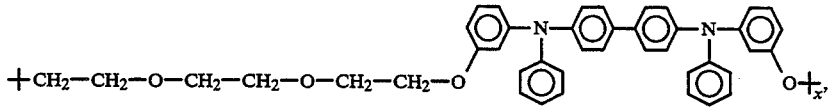

and

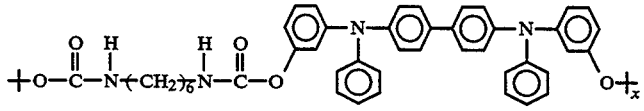

* * * * *